US006101842A

United States Patent [19]

Delacretaz

[11] Patent Number: 6,101,842

[45] Date of Patent: Aug. 15, 2000

[54] BRACELET

[75] Inventor: Richard Delacretaz, Granges-Paccot, Switzerland

[73] Assignee: Conseils et Manufactures VLG SA, Neuchatel, Switzerland

[21] Appl. No.: 09/050,099

[22] Filed: Mar. 30, 1998

[30] Foreign Application Priority Data

Apr. 3, 1997 [CH] Switzerland ..... 0785/97

[51] Int. Cl.[7] ..... A44C 5/02

[52] U.S. Cl. ..... 63/4; 63/3.1; 63/9; 63/38; 59/78; 59/80; 59/87; 24/265 B; 24/265 WS

[58] Field of Search ..... 63/3, 3.1, 4, 9, 63/38; 59/78, 80, 82, 93; 24/265 B, 265 WS

[56] References Cited

U.S. PATENT DOCUMENTS

| | | | |
|---|---|---|---|
| 3,073,492 | 1/1963 | Berger | 224/4 |
| 3,965,671 | 6/1976 | Kodera | 59/80 |
| 4,930,304 | 6/1990 | Meister | 59/80 |
| 5,365,753 | 11/1994 | Carrola | 63/4 |

FOREIGN PATENT DOCUMENTS

| | | | |
|---|---|---|---|
| 196996 | 10/1986 | European Pat. Off. | 59/82 |
| 0 347 841 | 12/1989 | European Pat. Off. . | |
| 0 549 979 | 7/1993 | European Pat. Off. . | |
| 2 502 916 | 10/1982 | France . | |
| 2 633 164 | 12/1989 | France . | |
| 2453678 | 5/1975 | Germany | 59/82 |
| 50-81569 | 7/1975 | Japan . | |
| 58-173505 | 10/1983 | Japan . | |
| 60-172514 | 11/1985 | Japan . | |
| 1-143918 | 10/1989 | Japan . | |
| 2-77204 | 3/1990 | Japan . | |
| 3-11815 | 2/1991 | Japan . | |
| 5-253009 | 10/1993 | Japan . | |
| 6-189812 | 7/1994 | Japan . | |
| 630789 | 7/1982 | Switzerland | 59/80 |
| 653 871 | 1/1986 | Switzerland . | |
| 193827 | 11/1992 | Taiwan . | |
| 244438 | 4/1995 | Taiwan . | |
| 248001 | 5/1995 | Taiwan . | |

*Primary Examiner*—Terry Lee Melius
*Assistant Examiner*—Andrea Chop

[57] ABSTRACT

A bracelet with decorative elements and support elements includes a front sections of the decorative elements with in one a semi-cylindrical hollow and in another a projection of corresponding dimensions to permit two juxtaposed decorative elements to be maintained in position whilst permitting their articulation; the support elements have a shape inscribed within the recess of the decorative elements, an end of this support element has a coupling member formed by a convex semi-cylindrical surface provided with a coaxial hole, the other end of this support element includes two laterally separated coupling members each formed by a convex semi-cylindrical surface and provided with coaxial holes; and pins passing through the holes of two adjacent support members effect their coupling and permit their articulation.

10 Claims, 4 Drawing Sheets

FIG. 1
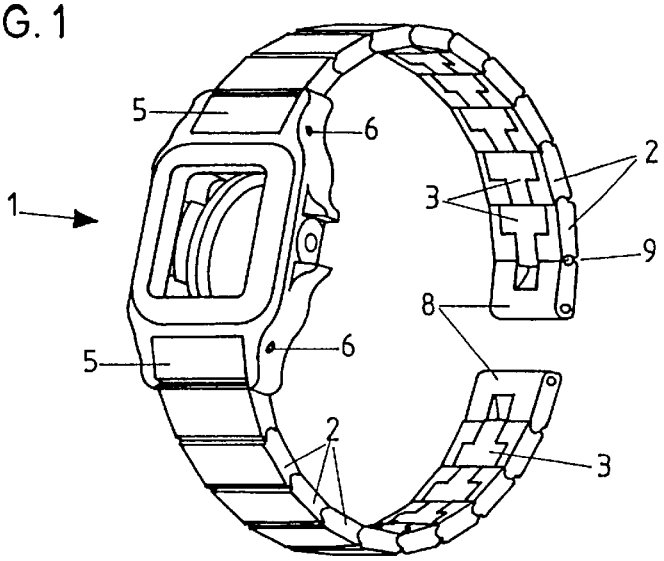
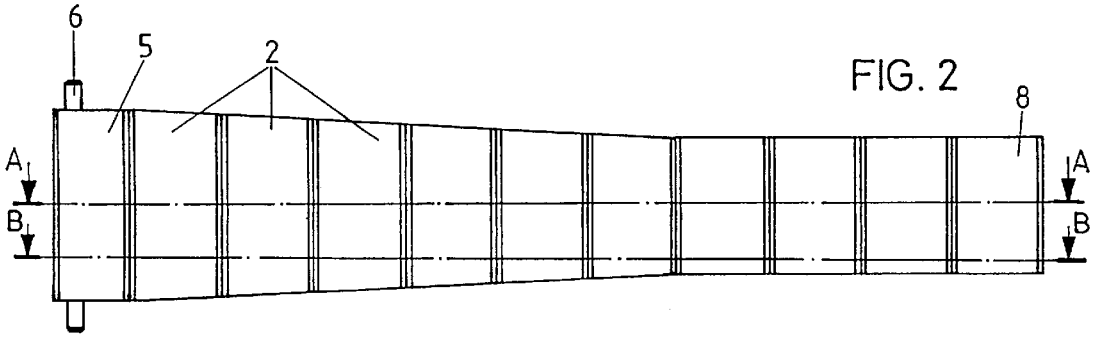
FIG. 2
FIG. 3
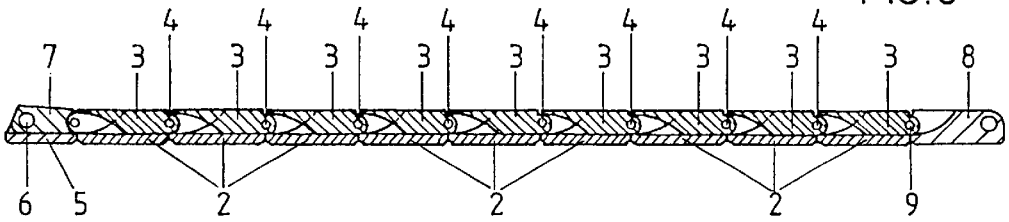
FIG. 4
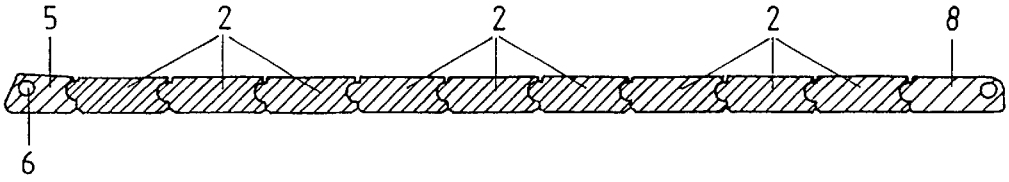

BRACELET

BACKGROUND OF THE INVENTION

The present invention relates to bracelets and watch bracelets of metal particularly precious metal, gold, platinum, silver or steel.

When these bracelets are comprised only by links of precious metal, for reasons of strength or economy of precious metal, the precious metal elements are secured on the support elements articulated to each other which themselves can be of steel. These constructions are complicated, requiring complicated machining and difficult mounting.

SUMMARY OF THE INVENTION

The present invention has for its object the provision of such a bracelet comprising decorative elements and supporting elements requiring fewer different pieces, which are easy to make and to assemble.

The bracelet according to the invention comprises decorative elements and support elements interconnected by connection pins.

BRIEF DESCRIPTION OF THE DRAWINGS

The accompanying drawing shows a watch case provided with a bracelet according to the invention.

FIG. 1 is a perspective view of the watch bracelet according to the invention assembled to a watch case.

FIG. 2 is a view from above of the flattened bracelet separated from the watch case.

FIG. 3 is a cross section on the line A—A of FIG. 2.

FIG. 4 is a cross section on the line B—B of FIG. 2.

DESCRIPTION OF THE PREFERRED EMBODIMENTS

Figure 5:
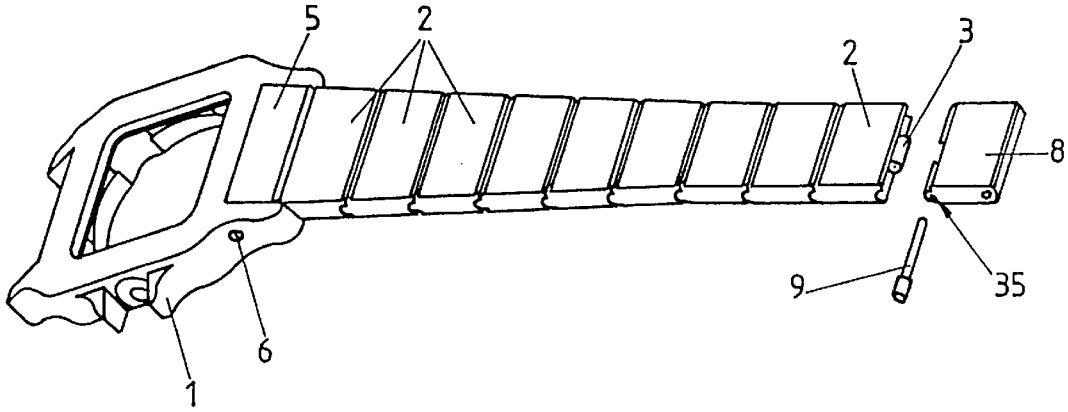
FIG. 5 is a perspective view showing a length of the bracelet assembled to the watch case as well as the manner of assembling a terminal link at the free end of the bracelet.
Figure 6:
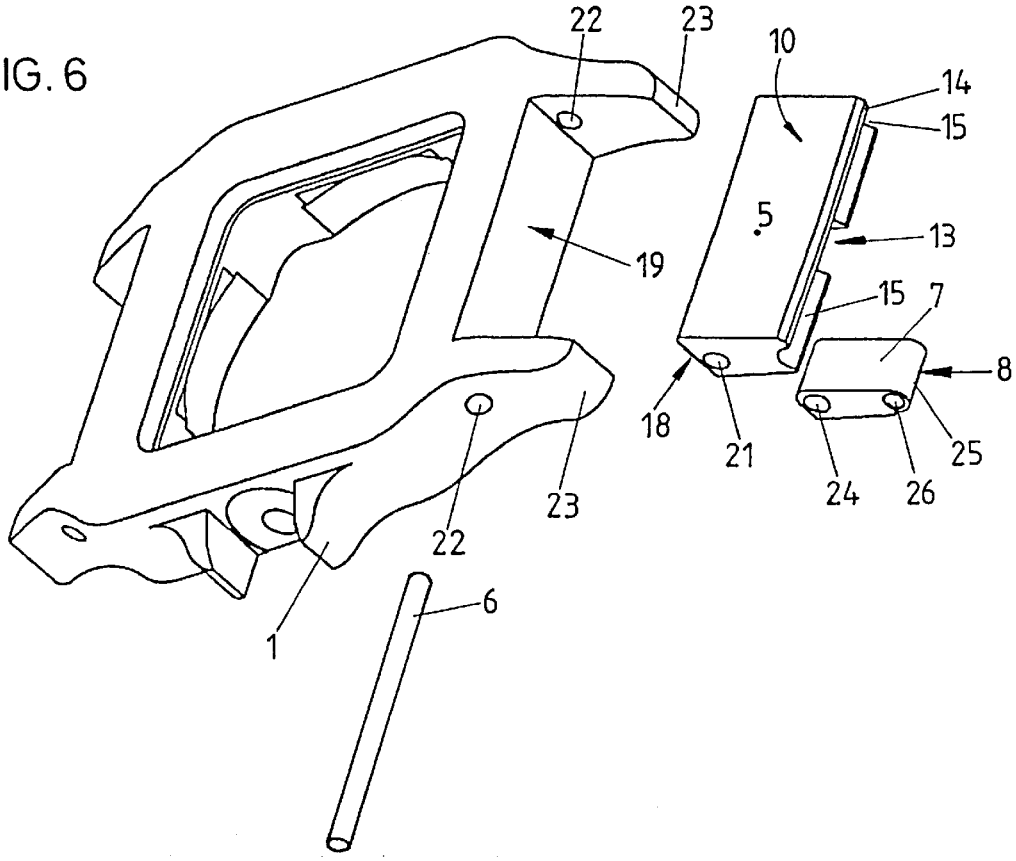
FIG. 6 shows in exploded perspective the securement of an end decorative element of the bracelet and of an end support element of the bracelet on the watch case.

The bracelet according to the present invention shown in the drawing as a watch bracelet, could of course be a continuous jewelry bracelet, without a watch, as will be explained later.

FIG. 1 shows a watch case 1 provided with a bracelet according to the invention. This bracelet comprises decorative elements 2 generally of precious metal but which could also be made of other materials such as precious or semi-precious stones, wood, steel, etc. and support elements 3 interconnected by pins 4.

The bracelet also comprises end decorative elements adapted to be connected by the aid of pins 6 to the watch case and support elements 7 also adapted to be secured to the watch case with the aid of the same pin 6.

The free ends of the connections of the bracelet each comprise a terminal link 8 constituted by a sole decorative element connected to the support element 3 of the adjacent link of the bracelet by a screw 9.

Apart from the end links of the bracelet which are monoblock and constituted only of a decorative element, each link of the bracelet is formed from a decorative element 2, 5 and a corresponding support element 3, 7.

Figure 7:
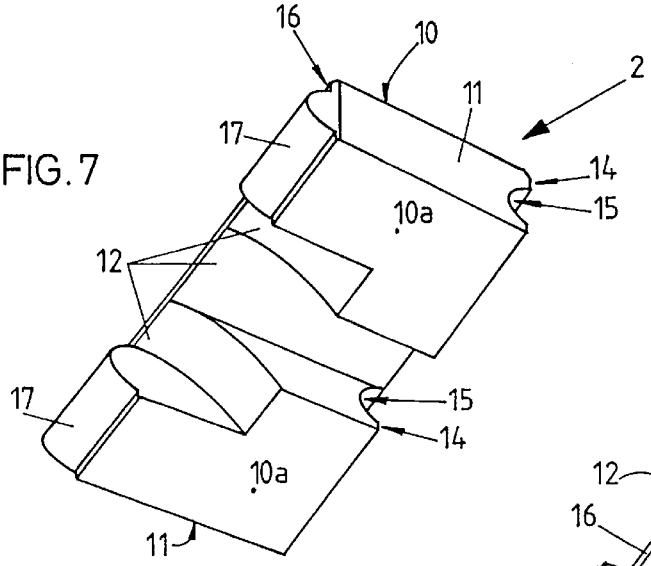
FIGS. 7 and 8 show in perspective from below and above a decorative element of the bracelet.
Figure 8:
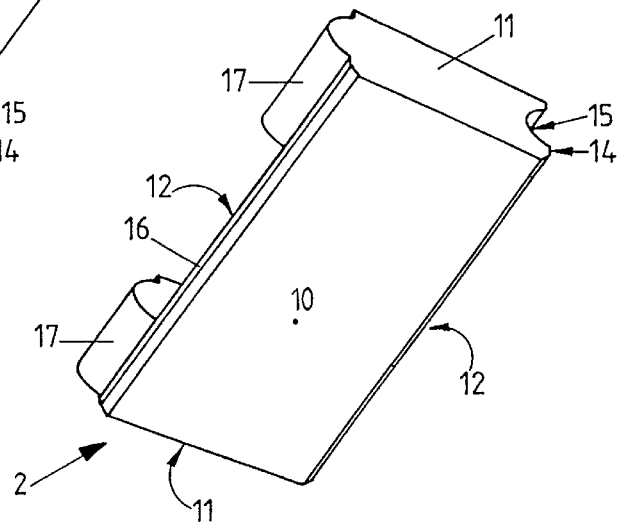
Figure 9:
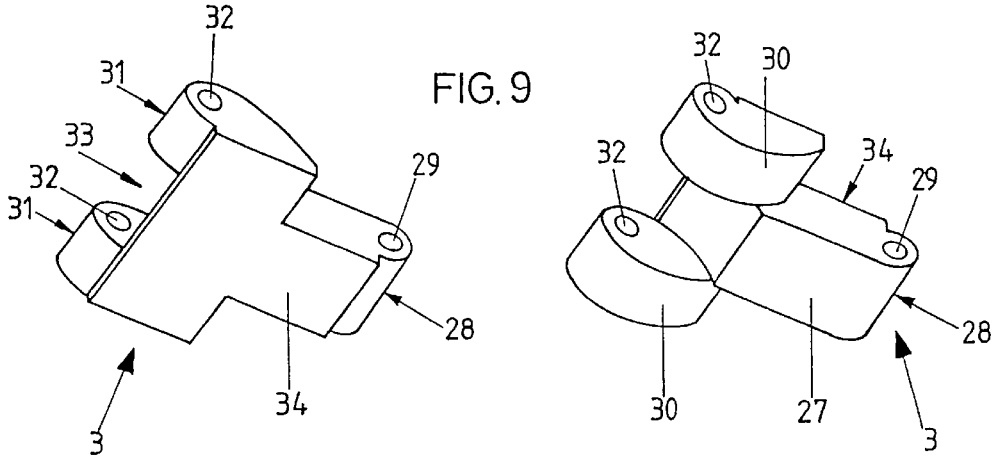
FIG. 9 shows in perspective a support element of the bracelet.
Figure 10:
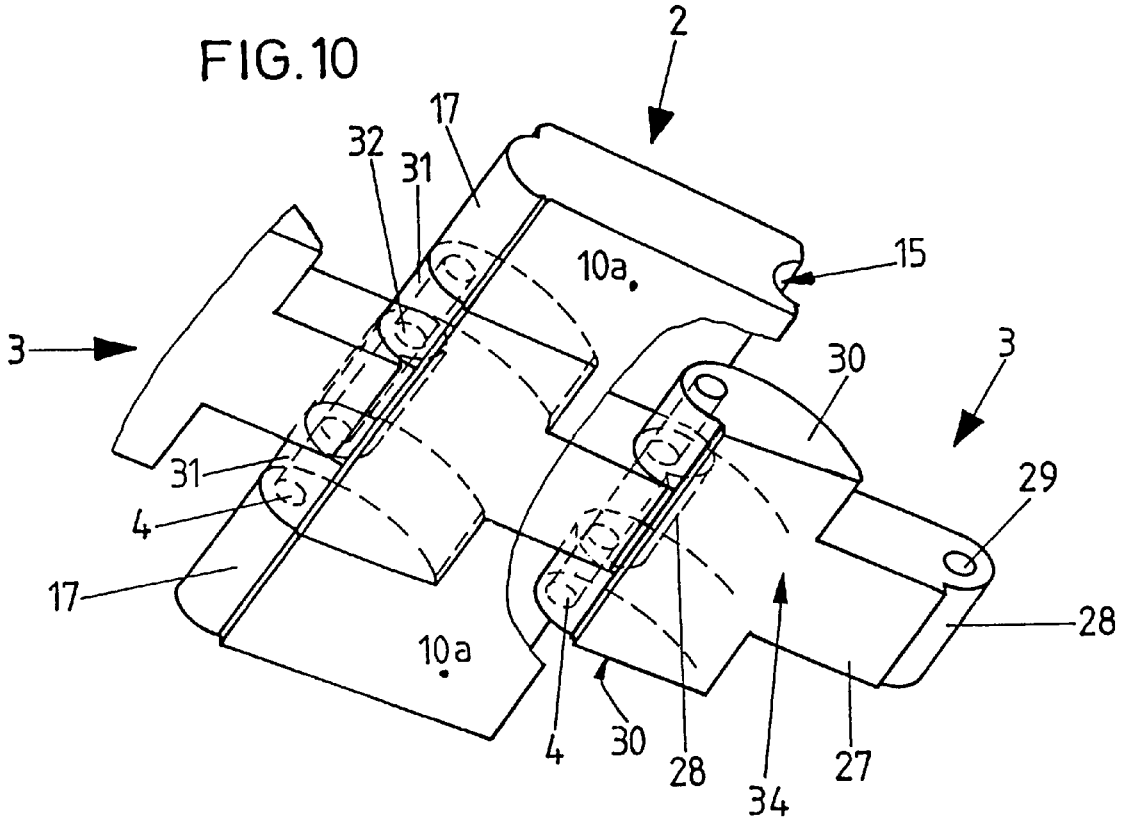
FIG. 10 shows on a larger scale, in perspective, the assembly of the interconnection of the decorative elements and support elements to close the bracelet.

Each decorative element 2 of the bracelet (FIGS. 7 and 8) is comprised in the illustrated example by a rectangular parallelepipedal body, the upper surface 10 being adapted to be worked, engine turned, set with stones or manufactured in any other fashion to give the desired appearance to the bracelet. As is seen particularly in FIGS. 1 and 2, the bracelet being assembled, only this surface 10 as well as the side surfaces 11, which could also be provided with decoration, are visible; they alone contribute to the appearance of the bracelet. In modifications, the shape of the body could be different, for example incurved.

Each decorative element 2 comprises a recess 12 opening on its lower surface 10*a* and on the two front sections located perpendicular to the longitudinal axis of the bracelet. This recess 12 is shaped to receive, by simple nesting, a support element 3. There is accordingly no mechanical connection securing a decorative element 2 to a support element 3; the support element 3 is simply disposed in the recess 12 of the corresponding decorative element 2.

The recess 12 comprises a straight portion opening on one of the front portions 14, perpendicular to the longitudinal of the axis, of the decorative element 2. This front portion 14 of the decorative element 2 comprises, on opposite sides of the recess 12, straight semicircular hollows 15 whose axis extends perpendicular to the longitudinal axis of the bracelet and hence of the recess 12.

The recess 12 comprises a wide portion opening on the other front section 16 of the decorative element 2 which extends also perpendicular to the longitudinal axis of the bracelet, respectively of the recess 12. This second front section 16 is provided, on opposite sides of the recess 12, with projections 17 of straight semi-cylindrical form.

The end decorative element 5 fixed to the watch case, comprises a front flat section 18 adapted to enter into contact with a surface 19 of the case 1, located between the horns 23 of this watch case 1. Adjacent this front flat section 18, the decorative element 5 comprises a through hole 21. When this decorative element 5 is assembled to the watch case 1, a pin 6 passes through the hole 21 and its ends are disposed in the holes 22 in the horns 23 of the watch case 1.

This end decorative element 5 comprises a recess or groove 13 opening on the lower and front surfaces 18, 15 adapted to receive an end support element 7.

In the assembled position, this support element 7 is disposed in the groove 13 of the end decorative element 5. This support element 7 comprises a first hole 24 which in assembled position is located along the axis of the holes 21. This hole 24 is also traversed by the pin 6 which thus connects the decorative element 5 and the support element 7 to the watch case 1.

The other front section of the end support element comprises a semi-cylindrical projecting portion 25 pierced by hole 26 coaxial to this semi-cylindrical projection 25 and which, once assembled to the case 1 and disposed in the groove 23, is also coaxial to the axis of the semi-cylindrical hollows 15 of the front surface 14 of the decorative element 5.

The support element 3 corresponding to the decorative elements 2 is disposed in the recess 12 of this latter and comprises a straight portion 27 whose end 28 has a convex semi-cylindrical shape provided with a hole 29 concentric to this cylindrical surface 28. The other portion of the support element 2 is wide and formed by two tenons 30 whose end 31 has a semi-cylindrical shape provided with holes 32 coaxial to these convex semi-cylindrical surfaces 31. The two tenons 30 are separated by a throat 33.

The uniqueness of these support elements 3 resides in the fact that their dimensions are such that they are disposed in the recess 12 of a decorative element 2 and that once in this position, the hole 29 of the semi-cylindrical end 28 is exactly aligned with the axis of the semi-cylindrical hollows 15 of the decorative element 2. Similarly, in this position, the semi-cylindrical surfaces 31 are exactly aligned with the semi-cylindrical projections 17 of the decorative element 2, the holes 32 being located along the axis of these semi-cylindrical projections 17.

When the support element 3 is disposed in the recess of a decorative element, its flat surface 34 is located in the plane of the lower surface 10*a* of this decorative element 2.

The assembly of the bracelet takes place stepwise. First the end support element 7 is disposed in the groove 13 of the end decorative element 5. Then this end link 5, 7 is disposed between the horns 23 of the watch case 1 such that the holes 22, 21 and 24 are aligned. The pins 6 are then introduced into these holes 22, 21 and 24 and thus secure the end link 5, 7 to the watch case.

A support element 3 is then positioned such that its semi-cylindrical surfaces 31 of the tenons 30 are disposed in the corresponding semi-cylindrical hollows 15 of the end decorative element 5, on opposite sides of the end 25 of the end support element 7. This done, the holes 26 and 32 are aligned and a pin 4 is introduced through them to assemble these two support elements to each other.

A decorative element 2 is then disposed on the support element that is desired to be assembled, positioning the semi-cylindrical projections 17 of the decorative element 2 in the corresponding semi-cylindrical hollows 15 of the adjacent decorative element and the hole 29 of the support element is thus aligned on the axis of the semi-cylindrical hollows 15 of the decorative element 2. Another support element 3 can then be coupled to the previous one, and then the following decorative element 2 can be emplaced. The bracelet can thus be stepwise assembled to the desired length.

To finish the free end of the bracelet, there is used a terminal link 8. This terminal link, which is a monoblock, comprises a frontal section similar to that of the decorative elements provided with semi-cylindrical projections. Only for this end link, one of the projections 17 is pierced by a hole 35 whilst the other is provided with a tapping. Thus, by placing this end link 8 with its semi-cylindrical projections 17 in the semi-cylindrical hollows 15 of the last decorative element 2 that was assembled, on opposite sides of the end 28 of the last assembled support element, the hole and the tapping of this terminal link are aligned with the hole 29 of the support element. A screw 9 is then introduced into the hole 35, 29 and screwed into the tapping of the link 8, which completes the assembly of the bracelet.

As a modification, the hole 35 of the end link 8 could be screw threaded and coacted with the screw threaded head of the screw 9. In this case, the other semi-cylindrical projection of the link 8 comprises a blind hole receiving the end of the screw 9.

It should be noted that in such a bracelet, there is no securement between the decorative elements 2 and the support elements 3. The support elements 3 are articulated and connected to each other by pins 4, but the decorative elements are simply interfitted with the corresponding support elements and also interfitted by their front sections with the adjacent decorative elements.

The decorative elements cannot be moved laterally because they are maintained in line by the support elements and they cannot separate from the adjacent decorative elements with which they are engaged by their front semi-cylindrical sections.

The free section of the end link 8 can comprise any coupling means to a traditional clasp to permit the closure of the bracelet on itself.

Once mounted, the decorative elements surround and hide the three sides, the support elements are visible only on the inner surface of the bracelet and hence invisible when the bracelet is worn.

Adjusting the length of the bracelet is very simple, as it suffices to remove or add a decorative element 2 and a support element 3 to change the length of the bracelet.

It is evident that the width of the decorative elements 2 can vary to permit the production of a bracelet having only a uniform width, for which are always used the same support elements.

An advantage of the bracelet described above also resides in the fact that the pins 4 articulating the two adjacent support elements cannot escape because they are trapped laterally between two projections 17 of a decorative element 2.

The recesses 12 of all the decorative elements 2 are identical as well as the support elements 3, which facilitates and reduces the cost of production of these elements and hence of the bracelet.

When the bracelet is not a watch bracelet and must be continuous and closed on itself, two possibilities exist. Either each end of the bracelet comprises a terminal link 8 and a conventional clasp is used to connect the two ends of the bracelet. Or there is used a decorative element 2 one of whose projections 17 has a hole and the other a tapping, and the ends of the bracelet are assembled with the aid of a screw 9 as in the case of the securement of the end link 8 to the end of the length of watch bracelet.

From the above, it will be understood that the principle of this new bracelet resides in the very particular characteristics of the latter, which are:

1. The decorative elements and the support elements are only interfitted with each other but not mechanically secured to each other.
2. One of the front sections of the decorative elements comprises a semi-cylindrical hollow and the other a semi-cylindrical projection. This permits two juxtaposed decorative elements to be maintained in position whilst permitting their articulation.
3. The support elements comprise at their ends members for coupling with adjacent support elements. These coupling members are constituted, at one end of the element by a convex cylindrical surface pierced by a passage and at the other end of the element by two convex semi-cylindrical surfaces, separated by a space, both being pierced by through holes.
4. In assembled position, the holes of the semi-cylindrical ends of the support elements are aligned with the axes of symmetry of the semi-cylindrical surfaces, projecting or recessed, forming the sections of the decorative element. Thus, the axis of articulation of the two adjacent support elements coincides with the axis of articulation of the two corresponding decorative elements.

What is claimed is:

1. A bracelet comprising:

decorative elements; and support elements, plural of said decorative elements having a lower surface, first and second front sections, and a recess opening on the lower surface and on the front sections, the first front sections comprising a semi-cylindrical hollow and the second front sections comprising a semi-cylindrical projection of corresponding dimensions, said support elements comprising a shape inscribed within the recess of said decorative elements, a first end of said support element comprising a single first coupling member formed by a convex semi-cylindrical surface provided with a first coaxial hole, said first coaxial hole having an axis, a second end of said support element comprising two laterally separated second coupling members each formed by a convex semi-cylindrical surface provided with second coaxial holes, said second coaxial holes having an axis, said recess having concave portions corresponding to said convex semi-cylindrical surfaces of said second end of said support element, said support element being disposed in the recess of a corresponding decorative element, the axes of the first and second coaxial holes coinciding respectively with an axis of symmetry of the semi-cylindrical hollows and projections of the front sections of said decorative elements and respectively with the axes of the second and first coaxial holes of adjacent support elements, wherein pins pass through the first and second coaxial holes of two adjacent support elements to effect coupling and permit articulation of the two adjacent support elements.

2. The bracelet of claim 1, wherein the semi-cylindrical surfaces comprise two holes, and a screw coacts with the holes of said semi-cylindrical surfaces and the first coaxial hole of a corresponding support element to permit closing the bracelet on itself.

3. The bracelet of claim 2, wherein the two holes of said semi-cylindrical surfaces comprise a blind hole and a tapping hole.

4. The bracelet of claim 1, further comprising:

end decorative elements with end element holes aligned in an assembled position with watch case holes located on horns of a watch case;

an end support element with an end support element hole; and an end pin engaged in the end element holes, the end support element hole, and the watch case holes to connect one of the end decorative elements to the watch case.

5. The bracelet of claim 1, further comprising:

end links, each end link having a first front section provided with semi-cylindrical projections, one of the semi-cylindrical projections of one of said end links being provided with an end hole and another of the semi-cylindrical projections of said one of said end links being provided with a concentric tapping; and a screw coacting with the end hole and the concentric tapping and with a corresponding first coaxial hole of a corresponding support element of the bracelet.

6. The bracelet of claim 5, wherein a second front section of the end links is provided with coupling means for coupling to a clasp.

7. A bracelet comprising:

decorative elements;

support elements; and end links, each of said decorative elements having a lower surface, first and second front sections, and a recess opening on the lower surface and on the front sections, the first front sections comprising a semi-cylindrical hollow and the second front sections comprising a semi-cylindrical projection of corresponding dimensions, said support elements comprising a shape inscribed within the recess of said decorative elements, a first end of said support element comprising a single first coupling member formed by a convex semi-cylindrical surface provided with a first coaxial hole, said first coaxial hole having an axis, a second end of said support element comprising two laterally separated second coupling members each formed by a convex semi-cylindrical surface provided with second coaxial holes, said second coaxial holes having an axis, said recess having concave portions corresponding to said convex semi-cylindrical surfaces of said second end of said support element, said support element being disposed in the recess of a corresponding decorative element, the axes of the first and second coaxial holes coinciding respectively with an axis of symmetry of the semi-cylindrical hollows and projections of the front sections of said decorative elements and respectively with the axes of the second and first coaxial holes of adjacent support elements, wherein pins passing through the first and second coaxial holes of two adjacent support elements effect coupling and permit articulation of the two adjacent support elements, each end link having a first front section provided with semi-cylindrical projections, one of the semi-cylindrical projections of one of said end links being provided with an end hole and another of the semi-cylindrical projections of said one of said end links being provided with a concentric tapping; and a screw coacting with the end hole and the concentric tapping and with a corresponding first coaxial hole of a corresponding support element of the bracelet.

8. The bracelet of claim 7, wherein the semi-cylindrical surfaces comprise two holes, and a screw coacts with the holes of said semi-cylindrical surfaces and the first coaxial hole of a corresponding support element to permit closing the bracelet on itself.

9. The bracelet of claim 8, wherein the two holes of said semi-cylindrical surfaces comprise a blind hole and a tapping hole.

10. The bracelet of claim 7, further comprising:

end decorative elements with end element holes aligned in an assembled position with watch case holes located on horns of a watch case;

an end support element with an end support element hole; and an end pin engaged in the end element holes, the end support element hole, and the watch case holes to connect one of the end decorative elements to the watch case.

* * * * *